US005678249A

United States Patent [19]

Smith

[11] Patent Number: 5,678,249

[45] Date of Patent: Oct. 21, 1997

[54] BOW HUNTER'S CAMOUFLAGE RELEASE MITTEN

[76] Inventor: Brian J. Smith, 805 Logan Ave., Bellevue, Nebr. 68005

[21] Appl. No.: 666,138

[22] Filed: Jun. 19, 1996

[51] Int. Cl.[6] ..... A41D 19/00

[52] U.S. Cl. ..... 2/161.5; 2/161.1; 2/158

[58] Field of Search ..... 2/158, 161.1, 161.5, 2/455

[56] References Cited

U.S. PATENT DOCUMENTS

| | | | |
|---|---|---|---|
| D. 313,674 | 1/1991 | Sharpe | D29/20 |
| D. 316,478 | 4/1991 | Brunner et al. | D2/610 |
| D. 349,998 | 8/1994 | Wang | D34/27 |
| 2,571,228 | 10/1951 | Freeman et al. | 2/158 |
| 2,941,214 | 6/1960 | Michael | 2/158 |
| 4,213,205 | 7/1980 | Smith | 2/161 A |
| 4,359,784 | 11/1982 | Harrington | 2/158 |
| 4,488,313 | 12/1984 | Delaney | 2/17 |
| 4,564,956 | 1/1986 | DiBuono | 2/16 |
| 4,683,592 | 8/1987 | Strongwater | 2/158 |
| 4,727,675 | 3/1988 | Huntt | 43/25 |
| 4,754,498 | 7/1988 | Stinmates | 2/158 |
| 4,805,338 | 2/1989 | Schublom | 43/25 |
| 5,172,427 | 12/1992 | Van Bergen et al. | 2/158 |
| 5,177,893 | 1/1993 | Huntt | 43/25 |
| 5,375,263 | 12/1994 | Cuccia | 2/158 |
| 5,461,728 | 10/1995 | Staszak | 2/161.5 |

*Primary Examiner*—Bibhu Mohanty
*Attorney, Agent, or Firm*—Zarley, McKee, Thomte, Voorhees & Sease; Dennis L. Thomte

[57] ABSTRACT

A bow hunter's mitten comprising a pair of side portions which define an upper edge, lower edge, forward end, and a rearward end. The mitten is designed to permit the bow hunter to insert his or her shooting hand into the mitten while the mechanical release is attached to the hunter's wrist. The forward end of the mitten has an opening formed therein to permit the end portion of the release to be extended therethrough four attachment to the bow string of the bow.

6 Claims, 3 Drawing Sheets

BOW HUNTER'S CAMOUFLAGE RELEASE MITTEN

BACKGROUND OF THE INVENTION

1. Field of the Invention

This invention relates to a bow hunter's mitten and more specifically to a bow hunter's mitten having an opening at one end thereof to permit one end of a mechanical release to extend therethrough for engagement with the bow string of a bow.

2. Description of the Related Art

Bow hunter's frequently hunt game such as deer, turkey, etc., in cold weather and it is difficult for the bow hunter to keep his or her shooting hand warm during the long waiting periods which normally occur between shots. Keeping the shooter's hand warm during periods of waiting is made even more difficult due to the fact that most bow hunter's use a mechanical release which is oftentimes secured to the wrist of the shooting hand. Even if a glove or mitten could be slipped over the shooter's hand and the mechanical release, the hunter would have to remove the glove or mitten from the shooting hand prior to connecting the release to the bow string to enable the hunter to draw the bow string back into an aiming position. Such movement which would be caused by removal of the glove from the shooter's hand would quite likely startle the game animal.

SUMMARY OF THE INVENTION

A bow hunter's mitten is described and which includes a pair of side portions defining an upper edge, a lower edge, a rearward end and a forward end. The rearward end of the mitten is open to enable the hunter to insert his/her hand, with the release attached thereto, to prevent the hunter's shooting hand from becoming cold. The mitten is provided with an elasticized opening formed in the forward end to enable the end of the mechanical release to be extended therethrough for attachment to the bow string of the bow in conventional fashion. The mitten has a configuration to accommodate the bow hunter's closed fist with the mechanical release attached thereto. Interchangeable sleeves, having various camouflage patterns thereon, may be slipped over the mitten as required so that the proper camouflage is achieved.

It is therefore a principal object of the invention to provide a bow hunter's mitten.

Still another object of the invention is to provide a bow hunter's mitten which permits the hunter to have the mechanical release attached thereto.

Still another object of the invention is to provide a bow hunter's mitten which may be placed on either the right hand or left hand of the hunter.

Still another object of the invention is to provide a bow hunter's mitten which may be fitted with different camouflage patterns for all seasons of hunting.

Still another object of the invention is to provide a bow hunter's mitten having an elasticized opening at the forward end thereof to enable the end portion of the release to be extended therethrough in order to attach the same to the bow string outwardly of the mitten.

Yet another object of the invention is to provide a bow hunter's mitten having a rearward opening which is large enough to slip over the hunter's clothing covering the hunter's wrist.

Still another object of the invention is to provide a bow hunter's mitten which is insulated.

Still another object of the invention is to provide a bow hunter's mitten which enables the bow hunter to keep his shooting hand warm and to make a swift and clean shot without startling the animal.

Still another object of the invention is to provide a bow hunter's mitten which is economical of manufacture, durable in use and refined in appearance.

These and other objects will be apparent to those skilled in the art.

DESCRIPTION OF THE PREFERRED EMBODIMENT

Figure 2:
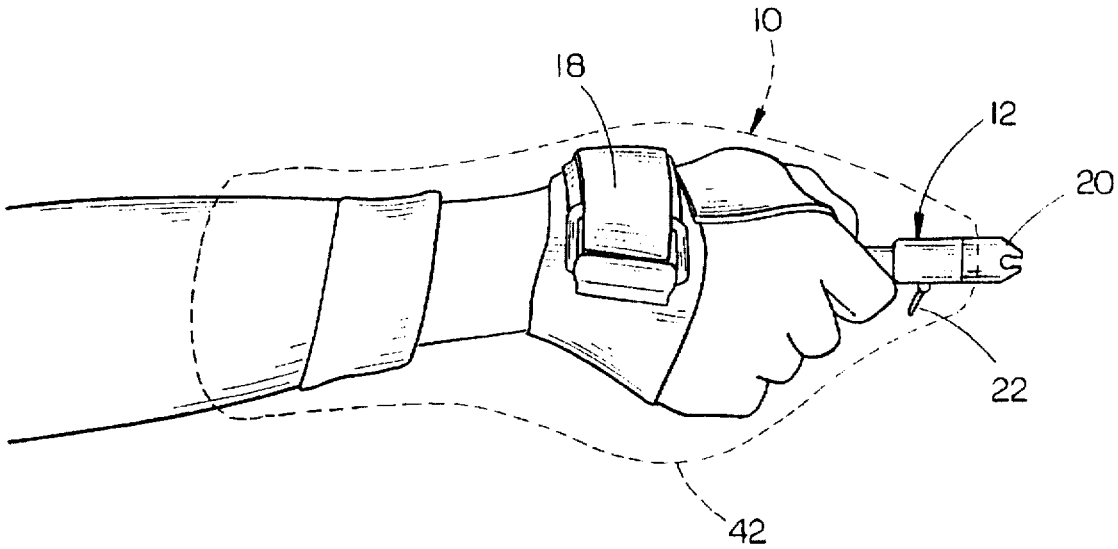
FIG. 2 is a side view of a bow hunter's hand having a mechanical release positioned thereon with the mitten of this invention being indicated by broken lines.

The numeral 10 refers generally to the bow hunter's mitten of this invention while the numeral 12 refers to a mechanical release designed to be attached to the bow string 14 of a bow 16 to draw the same into an aiming position and to permit the release thereof in conventional fashion. Although there are many types of mechanical releases, many releases include a wrist strap 18 designed to be positioned around the shooter's wrist in conventional fashion so that the end portion 20 of the release 12 extends between the shooter's index finger and thumb (FIG. 2). Release 12 also includes a release trigger 22.

Figure 1:
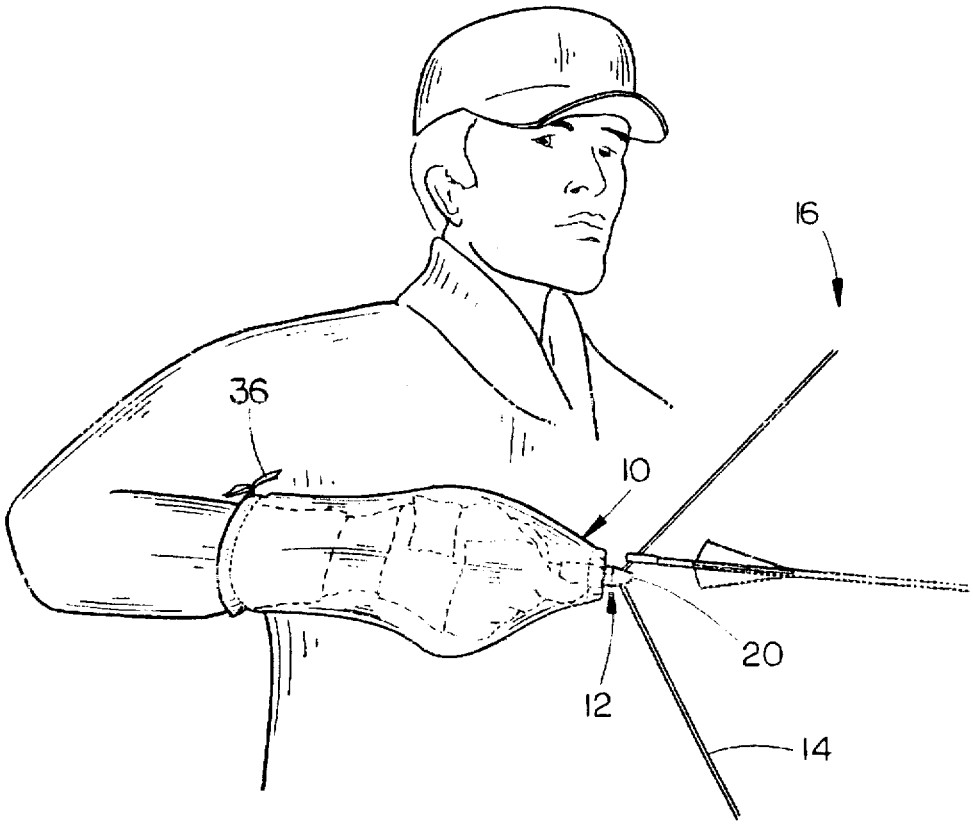
FIG. 1 is a view illustrating the mitten of this invention slipped over the shooting hand of a bow hunter.

For purposes of description, the mitten 10 of this invention includes side portions 24 and 26 which may be of single-piece construction or which may be a pair of panel portions. The side portions 24 and 26 are joined together by sewing to define a slightly curved top edge 28, slightly curved bottom edge 30, forward end 32, and an open rearward end 34 having a drawstring 36 associated therewith. The rearward end of mitten 10 also includes a snap closure tab 37. An opening 38 is formed in forward end 32 to permit the end portion 20 of release 12 to extend therethrough, as illustrated in FIGS. 1 and 2.

An elastic strap 40 is provided around the opening 38, as seen in the drawings, to partially resiliently close the opening 38 to reduce the amount of cold air which might enter the interior of the mitten while permitting the end portion 20 of release 12 to extend through the opening 38.

Figure 3:
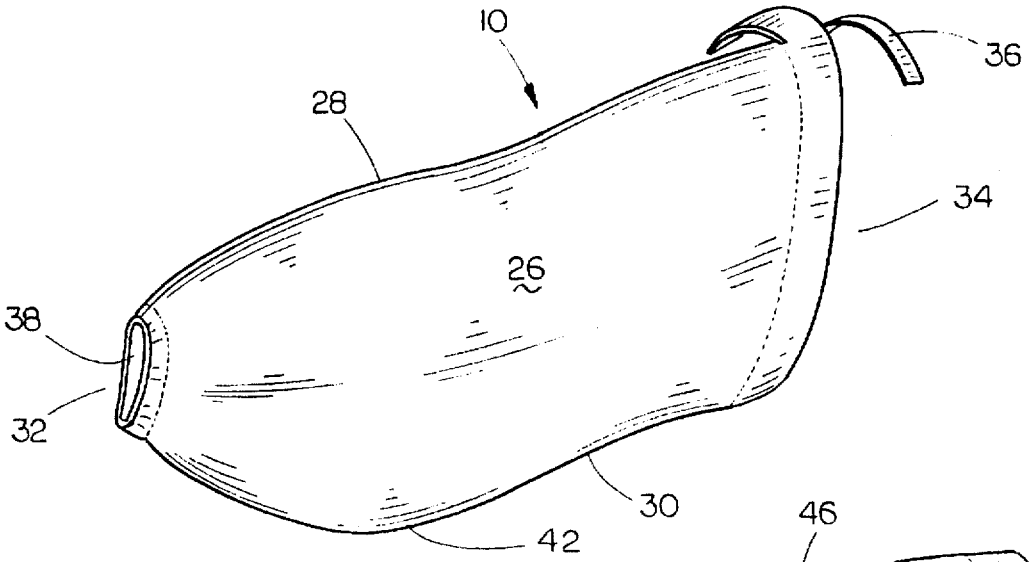
FIG. 3 is a front perspective view of the mitten of this invention.
Figure 5:
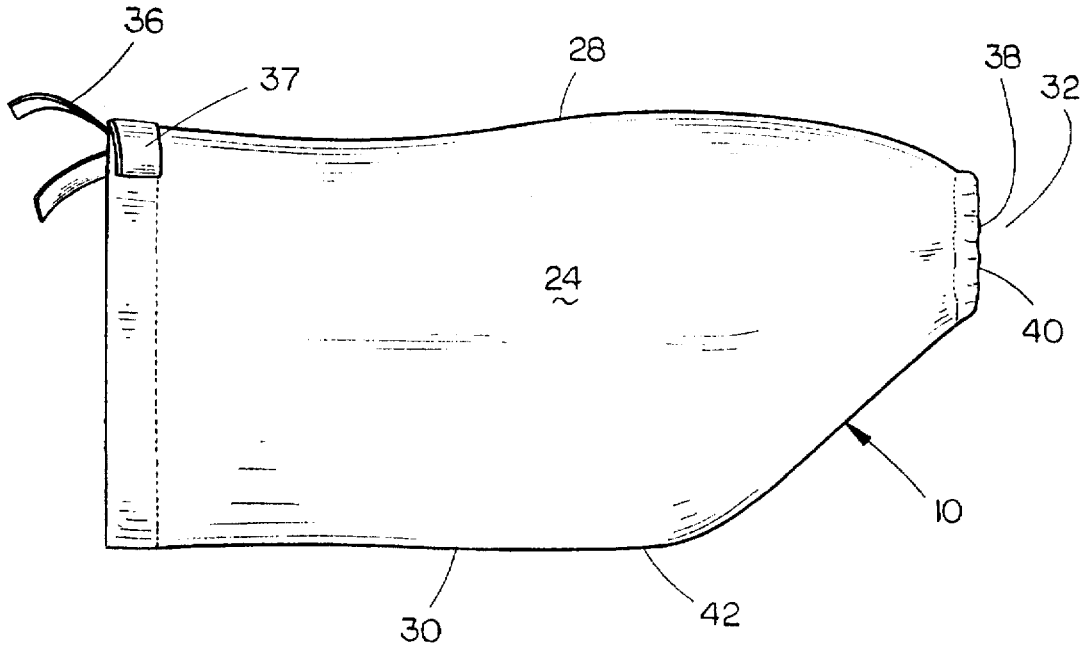
FIG. 5 is a side view of the mitten of this invention.
Figure 6:
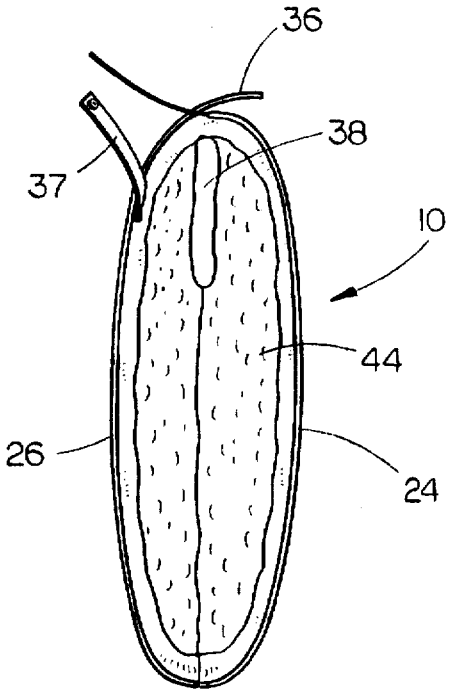
FIG. 6 is a rear view of the mitten of FIG. 5.
Figure 7:
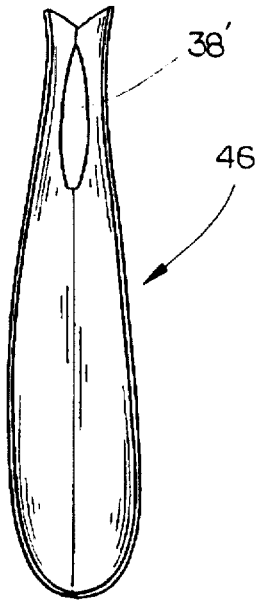
FIG. 7 is a rear view of one of the interchangeable sleeves.

As best seen in FIGS. 3 and 5, the opening 38 is positioned closer to the top edge 28 of the mitten 10 than it is to the bottom edge 30 so that there will be sufficient room beneath the opening 38 to accommodate the hunter's closed fist, as seen in FIG. 2. Further, the bottom edge 30 is provided with a small bulge 42 to provide additional space for the heel of the shooter's hand when the hand is in the closed fist position. The top edge 28 is also provided with a small bulge 43 to provide additional space to accommodate the upper part of the hunter's closed fist. The interior of the mitten 10 is also provided with suitable insulation generally referred to by the reference numeral 44.

Figure 4:
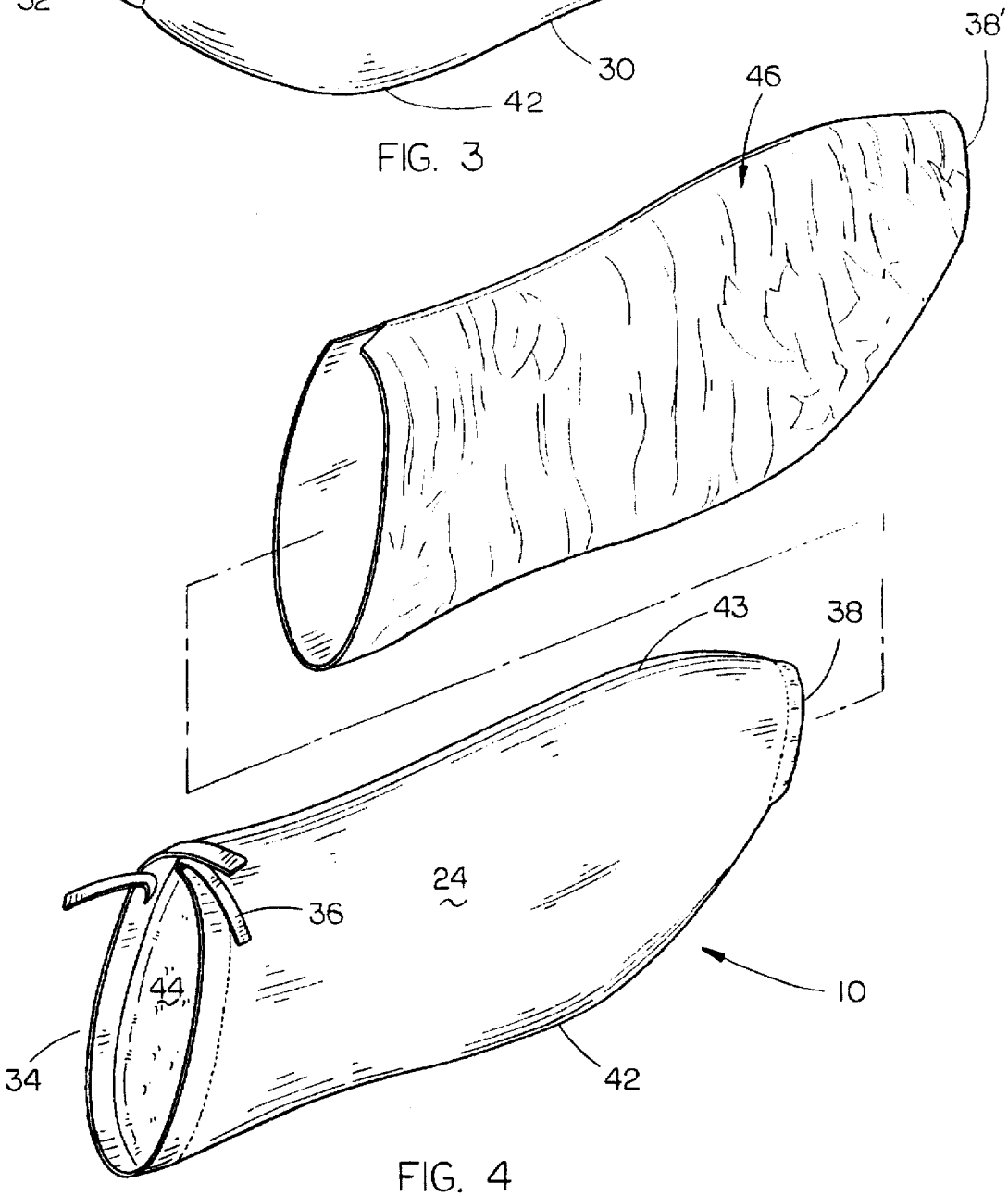
FIG. 4 is an exploded perspective view of the bow hunter's mitten of this invention and one of the interchangeable sleeves which may be slipped over the mitten.

Since it is desirable to provide camouflage for the mitten, and since different types of camouflage may be desired by the hunter, depending upon the season, interchangeable sleeves 46 are provided which may be slipped over the mitten 10, as seen in FIG. 4. Sleeve 46 has the same general configuration as mitten 10 and has an opening 38' provided therein which registers with opening 38 when the sleeve 46 has been slipped over the mitten 10. Thus, a basic mitten 10 may be purchased together with several different sleeves, of different camouflage patterns, so that the sleeve 46 having the desired camouflage pattern may be utilized.

In use, the mechanical release 12 is attached to the hunter's wrist in conventional fashion with the end portion 22 of the release 12 extending from the shooter's hand, as seen in the drawings. The hunter's hand with the release 12 attached thereto is inserted into the mitten through the open rearward end and the end portion 22 of the release 12 is extended through the opening 38 to enable the release to be attached to the bow string 14 in conventional fashion.

During the long periods of waiting which are normally associated with bow hunting, the warm mitten keeps the hunter's hand warm. The drawstring 36 may be tightened around the hunter's arm to prevent cold air from entering the rearward end of the mitten 10. The rearward end of the mitten 10 is also large enough to accommodate the sleeves of jackets or coveralls.

As previously described, the opening 38' is positioned closer to the upper edge of the mitten than it is to the lower edge of the mitten so that the mitten can accommodate the closed fist of the hunter, as illustrated in FIG. 2. As also previously described, the bulge or protrusion 42 accommodates the heel of the hunter's hand. The elasticized opening 38' does not interfere with the operation of the release 12, but prevents cold air from entering the interior of the mitten.

The bow may be operated in a quick and clean manner without the need for the hunter to remove the mitten from the shooting hand which could startle the animal being hunted.

Thus it can be seen that the invention accomplishes at least all of its stated objectives.

I claim:

1. In combination with a bow hunter's mechanical release, said release including a forward end portion for attachment to the bow string of the hunter's bow, comprising:

a bow hunter's mitten including a body having an interior defined by first and second side portions;

said body having an open rearward end to enable the bow hunter's shooting hand and said mechanical release to be inserted therethrough into the interior of said body, a forward end, an upper end, and a lower end;

said body having an opening formed in its forward end to permit said forward end portion of said mechanical release to be extended therethrough;

and a camouflage sleeve removably positioned over said body;

said sleeve having an open rearward end which registers with said open rearward end of said body;

said sleeve including a forward end having an opening formed therein which registers with said opening in said forward end of said body.

2. In combination:

a bow hunter's mechanical release, said release including a forward end portion for attachment to the bow string of the hunter's bow;

a bow hunter's mitten including a body having an interior defined by first and second side portions;

said body having an open rearward end to enable the bow hunter's shooting hand and said mechanical release to be inserted therethrough into the interior of said body, a forward end, an upper end, and a lower end;

said body having an opening formed in its forward end to permit said forward end portion of said mechanical release to be extended therethrough;

and a camouflage sleeve removably positioned over said body;

said sleeve having an open rearward end which registers with said open rearward end of said body;

said sleeve including a forward end having an opening formed therein which registers with said opening in said forward end of said body.

3. In combination:

a bow hunter's mechanical release, said release including a forward end portion which extends forwardly from the hunter's closed hand between the hunter's thumb and forefinger for attachment to the bow string of the hunter's bow, comprising:

a bow hunter's mitten including a body having an interior defined by first and second side portions;

said body having an open rearward end to enable the bow hunter's shooting hand and said mechanical release to be inserted therethrough into the interior of said body, a forward end, an upper end, and a lower end;

said body having an opening formed in its forward end to permit said forward end portion of said mechanical release to be extended therethrough;

and a camouflage sleeve removably positioned over said body;

said sleeve having an open rearward end which registers with said open rearward end of said body;

said sleeve including a forward end having an opening formed therein which registers with said opening in said forward end of said body;

said opening in said forward end of said body being positioned closer to said upper end than said lower end so that said opening in said forward end of said body is aligned with said forward end portion of said release which extends from the hunter's closed hand between the hunter's thumb and forefinger.

4. The combination of claim 3 wherein said lower end of said body includes a relatively small bulge to accommodate the heel of the hunter's closed fist.

5. The combination of claim 3 wherein said opening in said forward end of said body is sufficiently large enough to permit said forward end portion of said mechanical release to be extended therethrough but small enough to prevent excessive amounts of cold air to pass therethrough.

6. The combination of claim 3 wherein an elastic strap is provided at said forward end of said body which extends around said opening formed therein.

* * * * *